US009239014B2

(12) United States Patent
Yamazaki et al.

(10) Patent No.: US 9,239,014 B2
(45) Date of Patent: Jan. 19, 2016

(54) AUTOMOTIVE CONTROL DEVICE AND PERIOD MEASUREMENT METHOD FOR THE SAME

(71) Applicant: HITACHI AUTOMOTIVE SYSTEMS, LTD., Hitachinaka-shi, Ibaraki (JP)

(72) Inventors: Satoshi Yamazaki, Isesaki (JP); Naoto Hasegawa, Isesaki (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 202 days.

(21) Appl. No.: 14/023,048

(22) Filed: Sep. 10, 2013

(65) Prior Publication Data

US 2014/0081557 A1 Mar. 20, 2014

(30) Foreign Application Priority Data

Sep. 19, 2012 (JP) ..... 2012-205703

(51) Int. Cl.

| | |
|---|---|
| ***F02D 41/26*** | (2006.01) |
| ***F02D 1/16*** | (2006.01) |
| ***F02D 35/02*** | (2006.01) |
| *F02P 5/145* | (2006.01) |
| *F02P 7/06* | (2006.01) |
| *F02D 37/02* | (2006.01) |

(52) U.S. Cl.

CPC ..... *F02D 1/16* (2013.01); *F02D 35/028* (2013.01); *F02D 37/02* (2013.01); *F02P 5/145* (2013.01); *F02P 7/06* (2013.01)

(58) Field of Classification Search

CPC ..... F02D 1/16; F02D 37/02; F02D 41/009; F02P 5/145; F02P 7/077

USPC ..... 123/436, 472, 480, 406.23, 406.24; 701/103, 110, 111, 104–105; 73/114.03, 114.04, 114.26, 114.27

See application file for complete search history.

(56) References Cited

U.S. PATENT DOCUMENTS

| | | | | |
|---|---|---|---|---|
| 6,560,528 | B1 * | 5/2003 | Gitlin | F02D 41/263 123/406.62 |
| 8,804,882 | B2 * | 8/2014 | Nagai et al. | 375/345 |

FOREIGN PATENT DOCUMENTS

| | | | |
|---|---|---|---|
| JP | H02-034422 | A | 2/1990 |
| JP | 2008-124792 | A | 5/2008 |
| JP | 2008-309067 | | 12/2008 |
| JP | 2009-194611 | A | 8/2009 |

* cited by examiner

*Primary Examiner* — Hai Huynh
(74) *Attorney, Agent, or Firm* — Foley & Lardner LLP

(57) ABSTRACT

The invention relates to an automotive control device and a period measurement method for measuring a period of a pulse signal input from outside. The automotive control device processes the pulse signal input from outside using an analog filter in parallel with a digital filter. When a difference between a measured value of a period of an output signal of analog filter and a measured value of a period of an output signal of digital filter is less than a threshold value, the automotive control device selects the measured value of the period of the output signal of analog filter as the period of the pulse signal. Meanwhile, when the difference between the measured values is greater than the threshold value, the automotive control device selects the measured value of the period of the output signal of digital filter as the period of the pulse signal.

18 Claims, 4 Drawing Sheets

AUTOMOTIVE CONTROL DEVICE AND PERIOD MEASUREMENT METHOD FOR THE SAME

BACKGROUND OF THE INVENTION

1. Field of the Invention

The present invention relates to a technique for measuring a period of a pulse signal input from outside, for an automotive control device.

2. Description of Related Art Japanese Laid-Open Patent Application Publication No. 2008-309067 discloses that a control device for an internal combustion engine which receives a pulse signal that periodically changes according to an angle of a cam shaft of the internal combustion engine has a filter for removing noise components of the pulse signal.

The use of a digital filter as the filter for removing the noise components of the pulse signal enables a high-precision removal of the noise components. The digital filter, however, periodically operates, which causes a shift between a rising or trailing edge timing of the input pulse signal and an operation timing of the digital filter. This might cause an error between a period of the input pulse signal and a period of the output of the digital filter, and thus might reduce the measurement accuracy of the period.

SUMMARY OF THE INVENTION

Therefore, it is an object of the present invention to provide an automotive control device and a period measurement method for the same capable of measuring the period with high accuracy while suppressing the influence of noise.

In order to achieve the above object, according to an aspect of the present invention, there is provided an automotive control device including: a digital filter which processes a pulse signal input from outside; an analog filter which processes the pulse signal; and a period measurement unit which receives an output signal of the digital filter and an output signal of the analog filter, and outputs a measured value of a period of the pulse signal.

Moreover, according to an aspect of the present invention, there is provided a period measurement method for an automotive control device including the steps of: performing digital signal processing to extract predetermined frequency components from a pulse signal input from outside; performing analog signal processing to extract predetermined frequency components from the pulse signal; and measuring a period of the pulse signal on the basis of a signal after the digital signal processing and a signal after the analog signal processing.

Other objects and features of aspects of the present invention will be understood from the following description with reference to the accompanying drawings.

DESCRIPTION OF THE PREFERRED EMBODIMENTS

Figure 1:
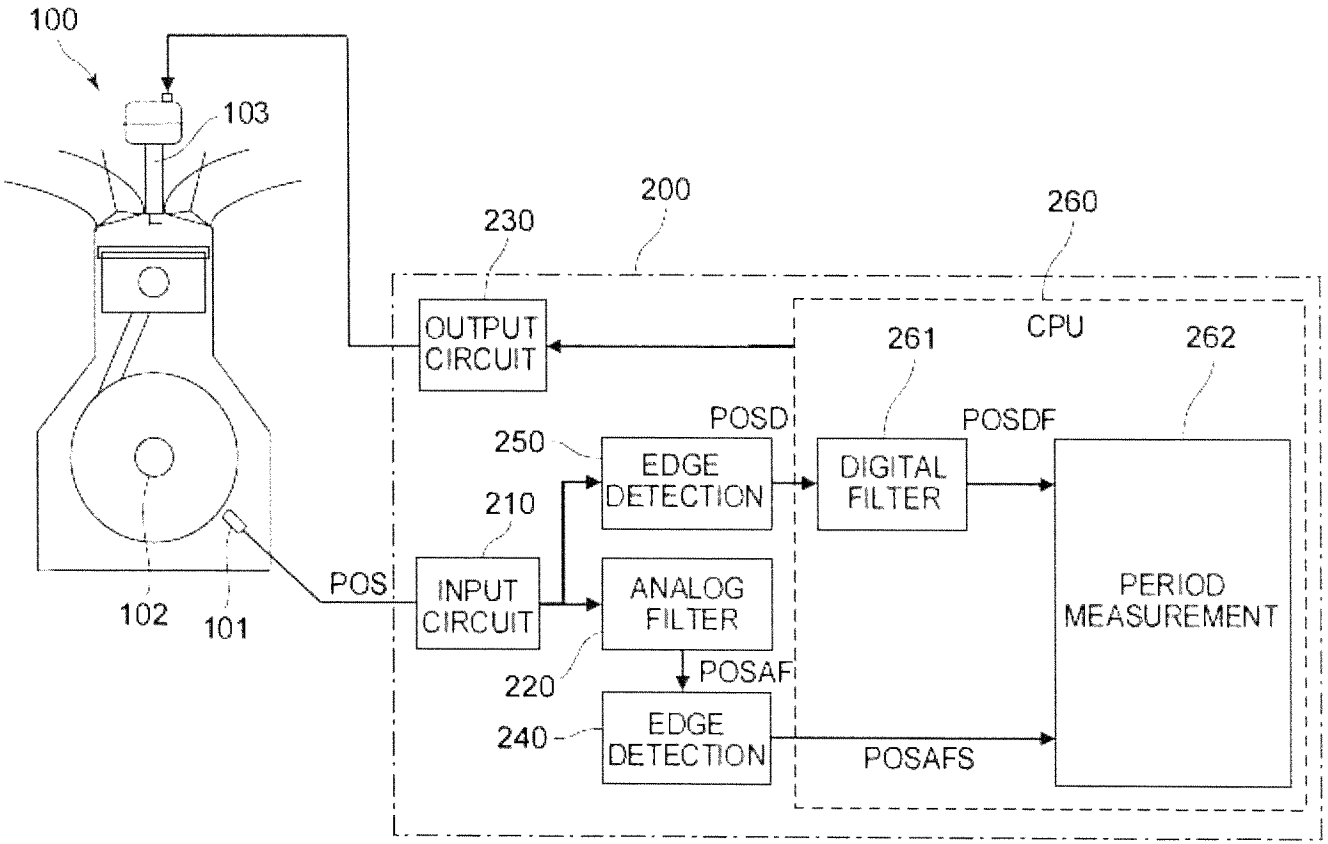
FIG. 1 is a block diagram illustrating a configuration of an automotive control device according to an embodiment of the present invention.

FIG. 1 illustrates a control device 200 which controls a vehicle internal combustion engine 100 as an example of an automotive control device according to the present invention.

Control device 200 including a microcomputer has an input circuit 210, an analog filter circuit 220, an output circuit 230, an edge detection circuit 240 for use in analog signal processing, an edge detection circuit 250 for use in digital signal processing, a central processing unit (CPU) 260, and the like.

Input circuit 210 receives a signal input from outside and output from a sensor, such as a crank angle sensor 101 provided in internal combustion engine 100.

Crank angle sensor 101 outputs a pulse signal POS which periodically changes in synchronization with a rotation of a crankshaft 102 of internal combustion engine 100. Pulse signal POS is an analog pulse signal, output of which changes every time crankshaft 102 rotates by a certain angle.

Pulse signal POS received by control device 200 via input circuit 210 is output to analog filter circuit 220 and edge detection circuit 250 in parallel.

Analog filter circuit 220 is a low-pass filter which removes high-frequency components (noise) contained in pulse signal POS by analog signal processing. A pulse signal POSAF in which high-frequency components have been removed after passing through analog filter circuit 220 is output to edge detection circuit 240.

Edge detection circuit 240 detects an edge of pulse signal POSAF by comparing the output level of pulse signal POSAF with a threshold value, and outputs a binary signal (rectangular pulse signal) POSAFS indicating the edge detection result to CPU 260.

On the other hand, edge detection circuit 250 detects an edge of pulse signal POS by comparing the output level of pulse signal POS with a threshold value, and outputs a binary signal (rectangular pulse signal) POSD indicating the edge detection result to CPU 260.

CPU 260 has functions such as a digital filter unit 261 and a period measurement unit 262 as software.

Digital filter unit 261 functions as a low-pass filter which removes high-frequency components (noise) included in pulse signal POSD by digital filtering (digital signal processing).

In addition, control device 200 may be provided with a digital signal processor (DSP) which functions as a digital filter, instead of digital filter unit 261.

Period measurement unit 262 receives pulse signal POSDF, in which the high-frequency components has been removed by the processing in digital filter unit 261, and pulse signal POSAFS, which is the output from edge detection circuit 240, to measure a period TPOS (ms) of pulse signal POS on the basis of these signals.

Pulse signal POS is a signal which is output every certain crank angle, and therefore period TPOS of pulse signal POS is a state quantity which correlates with rotation speed NE of internal combustion engine 100. Rotation speed NE (rpm) of internal combustion engine 100 is able to be calculated on the basis of period TPOS, and the crank angle is able to be converted to time on the basis of rotation speed NE.

Control device 200 detects a control timing of ignition with spark plug 103 of internal combustion engine 100 by using a number count of pulse signal POS from a reference crank angle and a time measurement starting from pulse signal POS, and generates an ignition control signal according to the detected control timing, and then outputs an ignition control signal to an ignition circuit of spark plug 103 via output circuit 230. In this regard, control device 200 converts the angle from pulse signal POS to the ignition control timing to time on the basis of rotation speed NE.

Control device 200 is able to detect the ignition control timing by converting the crank angle to time on the basis of rotation speed NE, and further to detect a fuel injection timing of a fuel injection valve (not shown).

Control device 200 uses rotation speed NE (rpm) computed based on period TPOS to compute the ignition timing or a fuel injection amount, and therefore the detection accuracy of period TPOS affects the computational accuracy of the ignition timing or the fuel injection amount.

Although high-frequency components can be removed with high precision in the digital filter, a shift caused by discrete operation timing in digital processing occurs between pulse signal POSDF after digital filtering and pulse signal POS output from crank angle sensor 101. Therefore, an error occurs between period TPOSDF of pulse signal POSDF after digital filtering and period TPOS of pulse signal POS output from crank angle sensor 101.

On the other hand, the analog filter has a lower removal performance for high-frequency components in comparison with the digital filter, while period TPOSAF of pulse signal POSAFS has a higher accuracy in comparison with period TPOSDF of pulse signal POSDF.

Specifically, pulse signal POSAFS after analog filtering becomes a signal having an edge synchronized with period TPOS of pulse signal POS output from crank angle sensor 101 with high accuracy, while pulse signal POSAFS is likely to have an edge affected by noise components.

Accordingly, period measurement unit 262 of control device 200 determines whether the edge of pulse signal POSAFS after analog filtering has been affected by noise on the basis of pulse signal POSDF after digital filtering. In addition, control device 200 determines whether to select period TPOSAF as period TPOS of the pulse signal, in other words, whether to use period TPOSAF to control internal combustion engine 100.

Figure 2:
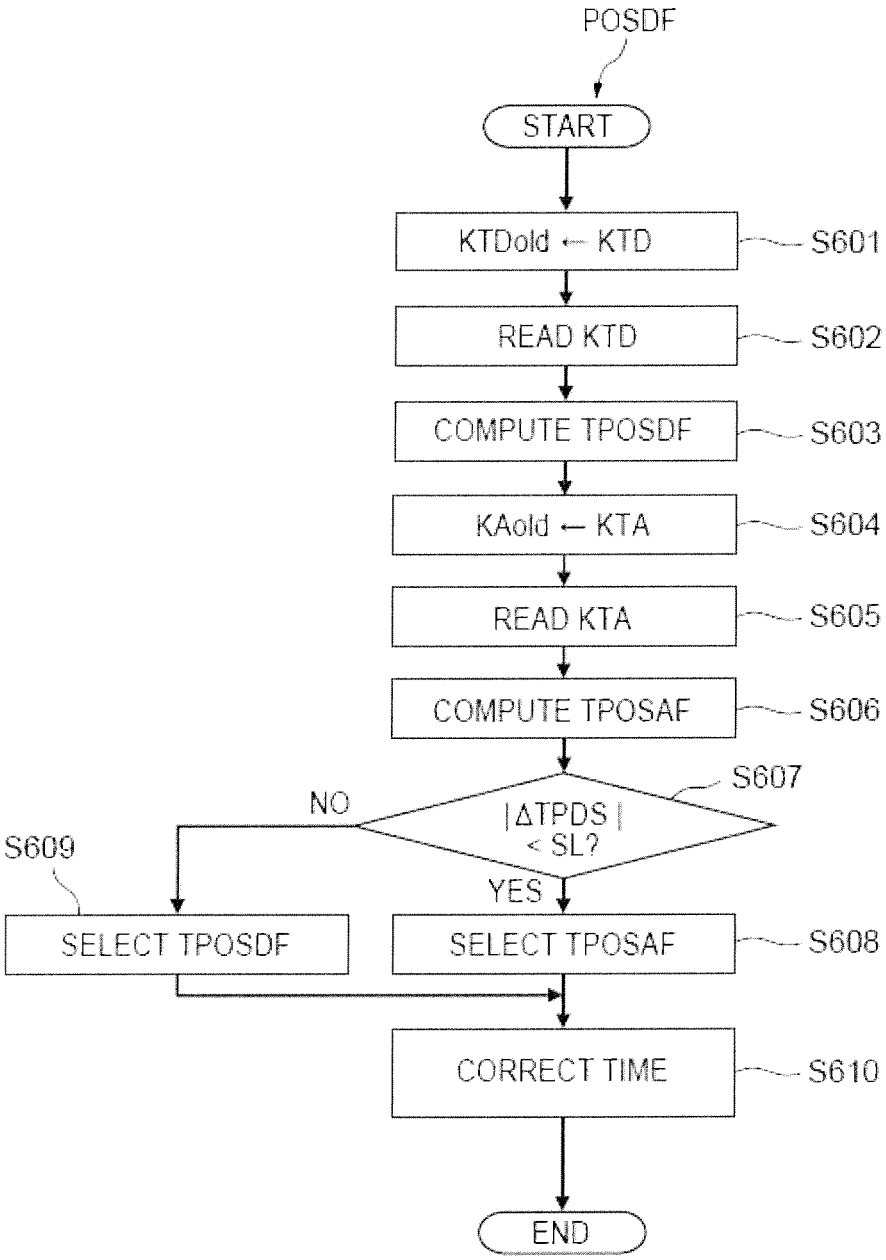
FIG. 2 is a flowchart illustrating interrupt processing based on a signal after digital filtering according to an embodiment of the present invention.

The following describes an example of the measurement of period TPOS in period measurement unit 262 with reference to the flowchart of FIG. 2.

In the processing illustrated in the flowchart of FIG. 2, it is assumed that a time constant for each filtering is preset so that a phase of pulse signal POSDF after digital filtering is delayed compared with a phase of pulse signal POSAFS after analog filtering.

A routine illustrated in the flowchart of FIG. 2 is executed by period measurement unit 262 every edge of pulse signal POSDF after digital filtering.

First, in step S601, period measurement unit 262 sets time information KTD stored at the time of the previous execution of this routine to previous value KTDold.

In the next step S602, period measurement unit 262 stores time information KTD at the current time as the latest value.

Then, in step S603, period measurement unit 262 computes period TPOSDF of pulse signal POSDF after digital filtering as a difference between previous value KTDold and latest value KTD.

In step S604, period measurement unit 262 sets time information KTA of the edge of pulse signal POSAFS after analog filtering, which has been stored as the latest value at the time of the previous execution of this routine, to previous value KTAold.

In the next step S605, period measurement unit 262 reads and stores the latest value of time information KTA updated every time the edge of pulse signal POSAFS after analog filtering is detected.

Then, in step S606, period measurement unit 262 computes period TPOSAF of pulse signal POSAFS after analog filtering as a difference between previous value KTAold and latest value KTA.

In step S607, period measurement unit 262 computes a difference ΔTPOS between period TPOSDF of pulse signal POSDF after digital filtering and period TPOSAF of pulse signal POSAFS after analog filtering, and determines whether the absolute value of difference ΔTPOS is less than a threshold value SL.

Threshold value SL is used to determine whether the difference between period TPOSDF and period TPOSAF is sufficiently small so that the difference is caused by a shift due to an operation timing of the digital filter, and is adapted in advance on the basis of an error of period TPOSDF due to the operation timing of the digital filter.

In other words, threshold value SL is preset so that difference ΔTPOS between the aforementioned periods is less than threshold value SL if period TPOSAF is measured without being affected by noise or the like and difference ΔTPOS between the aforementioned periods is greater than threshold value SL if a measurement error occurs in period TPOSAF caused by an unsuccessful removal of noise in the analog filtering.

Therefore, when the absolute value of difference ΔTPOS is less than threshold value SL, period TPOSAF is measured without being affected by noise or the like. In contrast, when the absolute value of difference ΔTPOS is equal to or greater than threshold value SL, it means that period TPOSAF is erroneously measured due to noise which has not been removed by analog filtering.

Accordingly, when period measurement unit 262 determines that the absolute value of difference ΔTPOS is less than threshold value SL in step S607, the operation of period measurement unit 262 proceeds to step S608, in which period measurement unit 262 selects period TPOSAF of pulse signal POSAFS after analog filtering as a period measured value of pulse signal POS.

The digital filtering can remove noise with high precision, and period TPOSDF is a measured value insusceptible to noise. An error, however, occurs due to digital operation timing in period TPOSDF. Accordingly, when it is estimated that period TPOSAF is measured without being affected by noise or the like, period measurement unit 262 selects period TPOSAF, which is a measurement result with higher accuracy, as a measured value for use in controlling internal combustion engine 100.

Therefore, when noise is successfully removed by analog filtering or when there is no superposition of noise on pulse signal POS, control device 200 is able to control the ignition timing of internal combustion engine 100 on the basis of period TPOSAF measured with high accuracy.

On the other hand, when the absolute value of difference ΔTPOS is equal to or greater than threshold value SL, period measurement unit 262 estimates that period TPOSAF is erroneously measured due to being affected by noise or the like, and then the operation proceeds to step S609, in which period measurement unit 262 selects period TPOSDF as a measured value for use in controlling internal combustion engine 100.

Although period TPOSDF sometimes may have a large measurement error in comparison with that of period TPOSAF which is not affected by noise, period TPOSDF is closer to an actual period TPOS than period TPOSAF which has been erroneously measured due to being affected by noise. Therefore, when period TPOSAF is erroneously measured due to being affected by noise, period TPOSDF is selected as a measured value for use in controlling internal combustion engine 100.

Therefore, it is possible to prevent the ignition timing and the like of internal combustion engine 100 from being controlled based on period TPOSAF erroneously measured due to the influence of noise.

In this regard, if control device 200 always controls internal combustion engine 100 on the basis of period TPOSDF, control insusceptible to noise may be achieved. This, however, may lead to the control using a measurement result having a greater error in comparison with that of period TPOSAF.

On the other hand, if control device 200 always controls internal combustion engine 100 on the basis of period TPOSAF, control device 200 is able to control internal combustion engine 100 on the basis of a precise period measured value in a case of no influence of noise. However, in a case of unsuccessful removal of noise from pulse signal POS with the analog filter, control device 200 may erroneously control internal combustion engine 100 on the basis of period TPOSAF, which is different from an actual value.

In contrast, in the processing illustrated in the flowchart of FIG. 2, period measurement unit 262 selects period TPOSDF in a case of unsuccessful removal of noise with the analog filter, and selects period TPOSAF in a case of successful removal of noise with the analog filter. Therefore, it is possible to prevent internal combustion engine 100 from being erroneously controlled on the basis of period TPOSAF erroneously measured due to an influence of noise while increasing the chances of controlling internal combustion engine 100 by using high-accuracy period TPOSAF as far as possible, thereby increasing the controllability of internal combustion engine 100.

Figure 3:
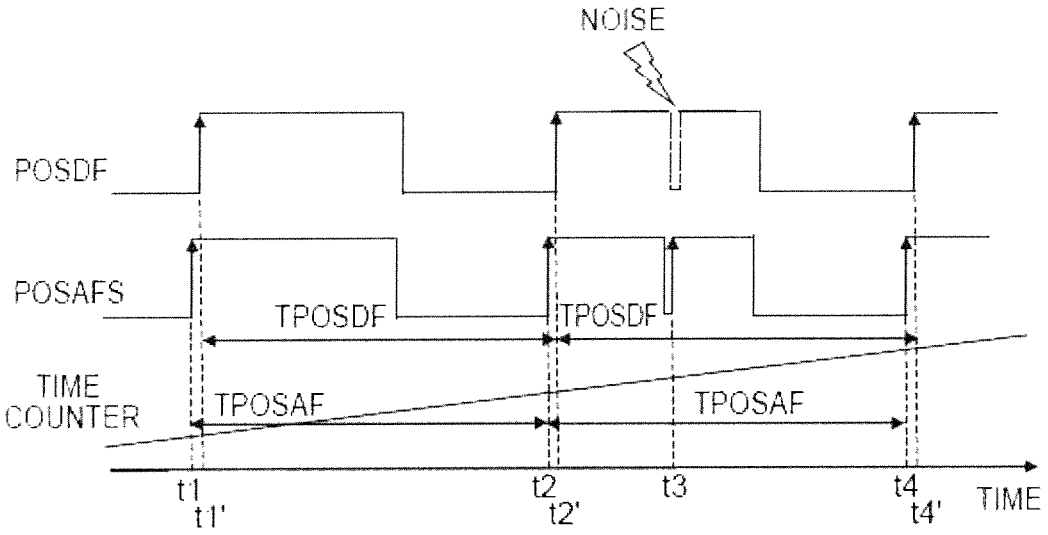
FIG. 3 is a timing diagram for describing characteristics of period measurement according to an embodiment of the present invention.

The timing diagram in FIG. 3 illustrates an example of the relationships among pulse signal POSAFS after analog filtering, pulse signal POSDF after digital filtering, a time counter, periods TPOSAF, and periods TPOSDF.

The time constant for each filtering is set so that the phase of pulse signal POSDF after digital filtering is delayed compared with the phase of pulse signal POSAFS after analog filtering, as described above.

In the processing illustrated in the flowchart of FIG. 2, period measurement unit 262 calculates period TPOSAF on the basis of the edge of pulse signal POSAFS after analog filtering, which is just before the edge of pulse signal POSDF after digital filtering.

Therefore, in the timing diagram of FIG. 3, period measurement unit 262 obtains period TPOSAF at time t2', which is an edge generation timing of pulse signal POSDF immediately after time t2, as a difference between time information KTAold obtained at time t1 and time information KTA obtained at time t2.

On the other hand, period TPOSDF is calculated based on time information for each edge of pulse signal POSDF after digital filtering. In the example illustrated in FIG. 3, period measurement unit 262 obtains period TPOSDF at time t2' as a difference between time information KTDold obtained by interrupt processing at time t1' and time information KTD obtained by interrupt processing at time t2'.

In this regard, in the example illustrated in FIG. 3, noise is not superimposed on pulse signal POSAFS after analog filtering between time t1 and time t2, which is a measurement section of period TPOSAF. Therefore, period measurement unit 262 determines that the absolute value of difference ΔTPOS is less than threshold value SL in the determination of difference ΔTPOS obtained when the interrupt processing of the flowchart in FIG. 2 is performed at time t2', thereby selecting period TPOSAF of pulse signal POSAFS after analog filtering as a period measured value for use in controlling internal combustion engine 100.

On the other hand, in the example illustrated in FIG. 3, noise which cannot be removed by analog filtering occurs at time t3 between time t2 and time t4, which is later than time t2 by one period of pulse signal POS, and edge detection circuit 240 erroneously detects an edge of pulse signal POSAFS after analog filtering.

In this case, when the edge of pulse signal POSAFS after analog filtering is able to be detected at time t4 just before time t4' at which the edge of pulse signal POSDF after digital filtering occurs, time information KTA of time t2 and time information KTA of time t4 are used for the calculation of period TPOSAF, thereby enabling the calculation of period TPOSAF with the influence of noise at time t3 eliminated.

On the other hand, when the edge of pulse signal POSAFS after analog filtering cannot be detected at time t4 due to an occurrence of noise in the vicinity of time t4, period TPOSAF is erroneously detected. In this case, period measurement unit 262 determines that period TPOSAF is erroneously measured by the influence of noise from the absolute value of difference ΔTPOS greater than threshold value SL, and then selects period TPOSDF as a measured value for use in control, instead of period TPOSAF. Therefore, also in this case, it is possible to acquire a measurement result of period TPOS from which the influence of noise is eliminated.

In step S610 of the flowchart of FIG. 2, control device 200 performs processing of compensating for a phase lag of pulse signal POSDF when the ignition control timing or the like is detected by the time measurement in which pulse signal POSDF serves as a reference.

Converting an angle to time TADV on the basis of period TPOSAF enables the angle to be detected with high accuracy by the time measurement. In addition, using pulse signal POSDF as a reference of the time measurement can prevent the measurement of time TADV in which a noise component serves as a reference, from being performed. The phase of pulse signal POSDF is delayed compared with the phase of pulse signal POSAFS, which causes an error in the detection of an angle position by this lag.

In this regard, the phase lag time of pulse signal POSDF relative to pulse signal POSAFS is able to be obtained as a difference between time information KTD and time information KTA.

Therefore, in step S610, control device 200 performs correction by subtracting a difference ΔKT between time information KTD and time information KTA from time TADV, which has been obtained by converting an angle on the basis of period TPOS. Then, the corrected time TADV (TADV=TADV−ΔKT) is measured based on pulse signal POSDF serving as a reference.

This enables the angle detection by the time measurement in which pulse signal POSDF serves as a reference so as to be equivalent to the detection in which pulse signal POSAFS serves as a reference. For example, in a case of measuring an ignition timing, the ignition timing is able to be detected with high accuracy.

Figure 4:
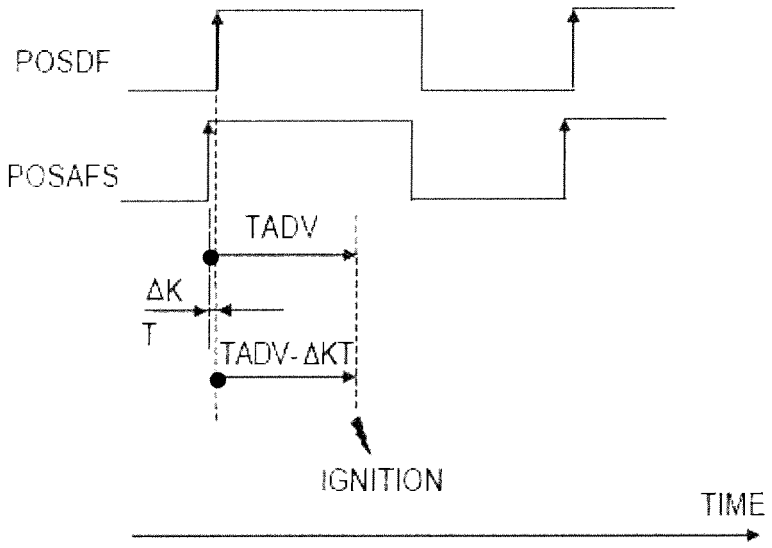
FIG. 4 is a timing diagram for describing processing of detecting an angle by a time measurement according to an embodiment of the present invention.

The timing diagram of FIG. 4 illustrates a detection of the angle by the time measurement in which pulse signal POSDF serves as a reference.

The edge of pulse signal POSDF is delayed from the edge of pulse signal POSAFS by ΔKT. Therefore, for measuring the time point at which time TADV elapsed from pulse signal POSAFS, the edge of pulse signal POSDF and the elapse of time "TADV−ΔKT" are measured, which results in measuring the same angle.

Although the contents of the present invention have been specifically described with reference to the preferred embodiments, it is apparent to those skilled in the art that various modifications and variations can be made on the basis of basic technical ideas and teachings of the present invention.

Although the phase of pulse signal POSDF is delayed compared with the phase of pulse signal POSAFS in the example illustrated in FIG. 3, the phase of pulse signal POSAFS may be delayed compared with the phase of pulse signal POSDF to the contrary. In this case, period measurement unit 262 is able to determine whether period TPOSAF is erroneously measured due to an influence of noise by comparing period TPOSAF with period TPOSDF by an interrupt at an edge of pulse signal POSAFS.

In addition, the pulse signal for performing the period measurement is not limited to pulse signal POS output from crank angle sensor 101, but the present invention may be also applicable to a measurement of a period of a pulse signal output from a vehicle speed sensor.

Furthermore, the pulse signal for performing the period measurement is not limited to a pulse signal output at fixed angular intervals, but can be a pulse signal output at varying angular intervals.

The entire contents of Japanese Patent Application No. 2012-205703, filed on Sep. 19, 2012, on which priority is claimed, are incorporated herein by reference.

While only select embodiments have been chosen to illustrate and describe the present invention, it will be apparent to those skilled in the art from this disclosure that various changes and modifications can be made herein without departing from the scope of the invention as defined in the appended claims.

Furthermore, the foregoing description of the embodiment according to the present invention is provided for illustration only, and it is not for the purpose of limiting the invention, the invention as claimed in the appended claims and their equivalents.

What is claimed is:

1. An automotive control device comprising:

a digital filter which processes a pulse signal output in synchronization with rotation of a rotating body which is rotated by an engine of a vehicle;

an analog filter which processes the pulse signal;

a period measurement unit which receives an output signal of the digital filter and an output signal of the analog filter, and outputs a measured value of a period of the pulse signal, a conversion unit which converts a predetermined angle of the rotating body to time on the basis of the measured value of the period output by the period measurement unit;

a correction unit which corrects the time on the basis of a phase difference between the output signal of the analog filter and the output signal of the digital filter;

an angle detection unit which measures the time corrected by the correction unit based on the output signal of the digital filter serving as a reference, and outputs a detection signal of an angle of the rotating body; and a control unit which performs a control process in the vehicle on the basis of the angle detected by the angle detection unit.

2. The automotive control device according to claim 1, wherein the period measurement unit determines whether to output a measured value of a period of the output signal of the analog filter as the period of the pulse signal on the basis of a comparison between the output signal of the digital filter and the output signal of the analog filter.

3. The automotive control device according to claim 1, wherein the period measurement unit compares a measured value of a period of the output signal of the analog filter with a measured value of a period of the output signal of the digital filter, to output one of the measured values of the periods.

4. The automotive control device according to claim 1, wherein on the basis of a difference between a measured value of a period of the output signal of the analog filter and a measured value of a period of the output signal of the digital filter, the period measurement unit outputs one of the measured values of the periods.

5. The automotive control device according to claim 1, wherein the period measurement unit outputs a measured value of a period of the output signal of the analog filter when a difference between the measured value of the period of the output signal of the analog filter and a measured value of a period of the output signal of the digital filter is less than a set value, and outputs the measured value of the period of the output signal of the digital filter when the difference is greater than the set value.

6. The automotive control device according to claim 1, wherein the rotating body is a crankshaft of an internal combustion engine serving as the engine of the vehicle, and the control unit controls at least one of an ignition timing and a fuel injection timing of the internal combustion engine on the basis of the angle detected by the angle detection unit.

7. The automotive control device according to claim 1, further comprising:

a first edge detection circuit which detects an edge of the pulse signal; and a second edge detection circuit which detects an edge of the output signal of the analog filter, wherein the digital filter processes an output signal of the first edge detection circuit, and wherein the period measurement unit receives the output signal of the digital filter and an output signal of the second edge detection circuit.

8. The automotive control device according to claim 1, wherein the analog filter and the digital filter are low-pass filters which remove high-frequency components of the pulse signal.

9. The automotive control device according to claim 1, wherein time constants of the analog filter and the digital filter are set so that a phase of the output signal of the digital filter is delayed compared with a phase of the output signal of the analog filter.

10. An automotive control device comprising:

a first filter means which extracts predetermined frequency components by digital signal processing from a pulse signal output in synchronization with rotation of a rotating body which is rotated by an engine of a vehicle;

a second filter means which extracts predetermined frequency components by analog signal processing from the pulse signal;

a period measurement means which receives an output signal of the first filter means and an output signal of the second filter means, and outputs a measured value of a period of the pulse signal;

a conversion means which converts a predetermined angle of the rotating body to time on the basis of the measured value of the period output by the period measurement means;

a correction means which corrects the time on the basis of a phase difference between the output signal of the analog filter and the output signal of the digital filter;

an angle detection means which measures the time corrected by the correction means based on the output signal of the digital filter serving as a reference, and outputs a detection signal of an angle of the rotating body; and a control means which performs a control process in the vehicle on the basis of the angle detected by the angle detection means.

11. A period measurement method for an automotive control device, the method measuring a period of a pulse signal output in synchronization with rotation of a rotating body which is rotated by an engine of a vehicle, the method comprising the steps of:

performing digital signal processing to extract predetermined frequency components from the pulse signal;

performing analog signal processing to extract predetermined frequency components from the pulse signal;

measuring the period of the pulse signal on the basis of a signal after the digital signal processing and a signal after the analog signal processing;

converting a predetermined angle of the rotating body to time on the basis of the measured value of the period of the pulse signal;

correcting the time on the basis of a phase difference between the signal after the digital signal processing and the signal after the analog signal processing;

measuring the time corrected based on the signal after the digital signal processing serving as a reference, detecting an angle of the rotating body by the measured time; and performing a control process in the vehicle via a control unit on the basis of the angle of the rotating body.

12. The period measurement method for the automotive control device according to claim 11, wherein the step of measuring the period comprises the steps of:

comparing the signal after the digital signal processing with the signal after the analog signal processing;

selecting one of a measured value of a period of the signal after the analog signal processing and a measured value of a period of the signal after the digital signal processing on the basis of the comparison result; and outputting the selected measured value as the period of the pulse signal.

13. The period measurement method for the automotive control device according to claim 11, wherein the step of measuring the period comprises the steps of:

measuring a period of the signal after the analog signal processing;

measuring a period of the signal after the digital signal processing;

comparing the measured value of the period of the signal after the analog signal processing with the measured value of the period of the signal after the digital signal processing;

selecting one of the measured value of the period of the signal after the analog signal processing and the measured value of the period of the signal after the digital signal processing on the basis of the comparison result; and outputting the selected measured value as the period of the pulse signal.

14. The period measurement method for the automotive control device according to claim 11, wherein the step of measuring the period comprises the steps of:

measuring a period of the signal after the analog signal processing;

measuring a period of the signal after the digital signal processing;

computing a difference between the measured value of the period of the signal after the analog signal processing and the measured value of the period of the signal after the digital signal processing;

selecting one of the measured value of the period of the signal after the analog signal processing and the measured value of the period of the signal after the digital signal processing on the basis of the difference; and outputting the selected measured value as the period of the pulse signal.

15. The period measurement method for the automotive control device according to claim 11, wherein the step of measuring the period comprises the steps of:

measuring a period of the signal after the analog signal processing;

measuring a period of the signal after the digital signal processing;

computing a difference between the measured value of the period of the signal after the analog signal processing and the measured value of the period of the signal after the digital signal processing;

outputting the measured value of the period of the signal after the analog signal processing as the period of the pulse signal when the difference is less than a set value; and outputting the measured value of the period of the signal after the digital signal processing as the period of the pulse signal when the difference is greater than the set value.

16. The period measurement method for the automotive control device according to claim 11, wherein the rotating body is a crankshaft of an internal combustion engine serving as the engine of the vehicle, the step of performing the control process comprising:

controlling at least one of an ignition timing and a fuel injection timing of the internal combustion engine on the basis of the angle of the crankshaft.

17. The period measurement method for the automotive control device according to claim 11, wherein the step of performing the digital signal processing comprises the step of performing the digital signal processing to remove high-frequency components of the pulse signal, and wherein the step of performing the analog signal processing comprising the step of performing the analog signal processing to remove high-frequency components of the pulse signal.

18. The period measurement method for the automotive control device according to claim 11, wherein time constants of the digital signal processing and the analog signal processing are set so that a phase of the signal after the digital signal processing is delayed compared with a phase of the signal after the analog signal processing.

* * * * *